United States Patent [19]

Ingalls et al.

[11] 4,185,232

[45] Jan. 22, 1980

[54] MULTIPLE FLASHLAMP OPERATING CIRCUIT

[75] Inventors: Jeffrey D. Ingalls, Ipswich; Ellison H. Kirkhuff, Needham, both of Mass.

[73] Assignee: GTE Sylvania Incorporated, Stamford, Conn.

[21] Appl. No.: 937,648

[22] Filed: Aug. 28, 1978

[51] Int. Cl.[2] ..... H05B 41/34

[52] U.S. Cl. ..... 315/241 R; 315/200 A; 315/201; 315/232; 315/324; 340/25; 340/331

[58] Field of Search ..... 315/200 A, 201, 232, 315/241 R, 241 P, 241 S, 323, 324; 340/25, 77, 105, 331

[56] References Cited

U.S. PATENT DOCUMENTS

| | | | |
|---|---|---|---|
| 3,031,599 | 4/1962 | Paschke et al. | 315/241 R X |
| 3,390,304 | 6/1968 | Scott et al. | 315/241 R X |
| 3,873,962 | 3/1975 | Eggers et al. | 340/25 |
| 3,973,168 | 8/1976 | Kearsley | 315/232 |

*Primary Examiner*—Eugene R. LaRoche

*Attorney, Agent, or Firm*—Edward J. Coleman

[57] ABSTRACT

A DC circuit for efficiently operating two arc discharge flashlamps. The lamps are parallel connected across a single supply storage capacitor, and a single trigger capacitor is employed in connection and the two alternately activated trigger sources for the two lamps.

5 Claims, 2 Drawing Figures

MULTIPLE FLASHLAMP OPERATING CIRCUIT

BACKGROUND OF THE INVENTION

The invention relates generally to electrical circuits for operating arc discharge flashlamps, and more particularly, to a more efficient circuit for operating a plurality of flashlamps.

Such flashlamps are employed in a variety of applications; for example, flash photography; reprographic machines; laser excitation; and warning or directional flashers for airplanes, towers, road barricades, marine equipment, and tower-mounted approach lighting systems for airport runways. An indicator structure application in which the DC powered circuit of the present invention is particularly useful is described in co-pending application Ser. No. 937,649, filed concurrently herewith and assigned to the present assignee.

Flashlamps of the type referred to herein generally comprise two spaced-apart electrodes within an hermetically sealed glass envelope having a rare gas fill, typically xenon, at a sub-atmospheric pressure. In typical prior art operating circuits, such lamps are connected across an energy storage device, such as one or more capacitors, charged to a substantial potential, but insufficient to ionize the xenon gas fill. Upon application of an additional pulse of sufficient voltage, the xenon is ionized and an electric arc is formed between the two electrodes, discharging the storage device through the flashlamp, which emits a burst of intense light. In many cases, the pulse voltage is applied between an external electrode, such as a wire wrapped around the envelope, and one of the electrodes; this is referred to as shunt triggering. However, in other cases, an external wire is not feasible since it may result in an undesirable arcing between the trigger wire and a proximate lamp reflector, or else the high potential applied to the external trigger wire might be hazardous to operating personnel. In those cases, the lamp may be internally triggered by applying the pulse voltage directly across the lamp electrodes, a technique referred to as injection triggering. Usually, the voltage required is about 30% to 50% higher than that required to trigger the same lamp with an external trigger wire, and the trigger transformer secondary must carry the full lamp circuit.

In applications requiring two (or more) flashlamps, the lamps have been series-connected across the storage capacitor means, with a single injection trigger circuit used for the series lamp combination. Where two lamps are required to be flashed in alternate sequence, a separate storage capacitor and RC trigger supply has been employed for each lamp, with a gating signal alternately activating the trigger circuits. Accordingly, such prior art circuits for sequenced flashlamps add significantly to the cost and bulk of the power supply.

One approach for overcoming the aforementioned shortcomings of conventional flashlamp arrangements is described in co-pending application Ser. No. 865,405, filed Dec. 29, 1977, now abandoned and assigned to the present assignee. Briefly, the operating circuit of this co-pending application employs a single storage capacitor means and uses the charging current of the storage capacitor, as well as the discharge current, for purposes of lamp energization. More specifically, first and second arc discharge flashlamps are series connected across a supply voltage source comprising a large direct current storage bank. The storage capacitor means is connected between the junction of the lamps and one terminal of the source. Respective injection or shunt means are provided for coupling trigger pulses to each lamp, and a succession of high voltage trigger pulses are alternately applied through the respective coupling means to the lamps. Each trigger pulse applied to the first lamp effects an arc path therethrough for charging the capacitor, and each trigger pulse applied to the second lamp effects an arc bath therethrough for discharging the capacitor. Hence, the storage capacitor is charged through one lamp and discharged through the other in response to trigger pulses, which are applied in alternate sequence to the lamps. In essence, the lamps function as alternately actuated switches for charging and discharging the capacitor.

Although offering a number of significant advantages, the above-discussed circuit also has a disadvantage in that the power source requires a large DC storage means, such as a bank of capacitors. This tends to add to the bulk, weight, and expense of the DC power source. Such factors detract from efforts to provide compact, low-cost flashlamps for photographic applications, lightweight runway flashers for mounting on frangible towers, or various other indicator structures such as road barricades.

One approach which has been taken to overcome such disadvantages, with respect to the discharge storage bank, is described in co-pending application Ser. No. 865,564 filed Dec. 29, 1977, now U.S. Pat. No. 4,142,130, and assigned to the present assignee. This improved circuit uses the above-described multiflash arrangement wherein a pair of flashlamps are alternately triggered to charge and discharge a storage capacitor through the lamps, but in this instance, the lamps and storage capacitor means are connected directly to an AC source. In this manner, the first lamp draws the major portion of its operating voltage directly from the AC source with no substantial energy storage means located therebetween other than a storage capacitor means. Of course, this improved circuit has the drawback of requiring the availability of an AC power line, and thus is not suitable for applications in remote locations where only battery sources may be employed. Further, the circuitry continues to require a separate RC timing circuit for controlling the triggering of each flashlamp.

SUMMARY OF THE INVENTION

Accordingly, it is an object of the present invention to provide an improved operating circuit for arc discharge flashlamps.

It is a particular object to economically provide a batter-powered operating circuit for arc discharge flashlamps.

These and other objects, advantages, and features are attained, in accordance with the principles of the present invention, by a circuit comprising a DC to AC converter, supply circuit means including a first storage capacitor connected to the AC output of the converter, and first and second arc discharge flashlamps connected in parallel across the first storage capacitor. The circuit further includes respective means for coupling trigger pulses to the first and second lamps, and means for generating and alternately applying a succession of high voltage trigger pulses through the respective coupling means to the first and second lamps, whereby the lamps are flashed in alternate sequence. The circuitry for providing the trigger pulses comprises first and second pulse transformers, the secondary winding of each being connected to a respective one of the coupling means, and the primary windings respectively connected in series with first and second gate-controlled switching devices. A charging circuit including a second storage capacitor is connected to the AC output of the converter, and the primary of the first transformer and its series-connected first switching device are connected in parallel with the primary of the second transformer and its series-connected second switching device across the second storage capacitor. A pulse-generating means provides first and second pulse outputs which are respectively connected to the control gates of the first and second switching devices. The gating pulses are alternately applied to the first and second switching devices at a fixed time interval, and thus, the high-voltage trigger pulses are alternately applied to the first and second flashlamps at approximately the same fixed time interval. Hence, the respective circuit portions controlling the charge rates of the first and second storage capacitors are selected to provide a full charge on the capacitors within that fixed time interval.

Accordingly, the present invention provides an efficient flashlamp operating circuit which may be powered by a DC source and which requires only one storage capacitor for both of the lamps and a single trigger circuit capacitor for both of the trigger pulse transformers. Both lamps appear across the supply circuit storage capacitor and are alternately triggered by the transformers, and the first and second switching devices alternately discharge the single trigger circuit storage capacitor through the primaries of the first and second pulse transformers, respectively.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
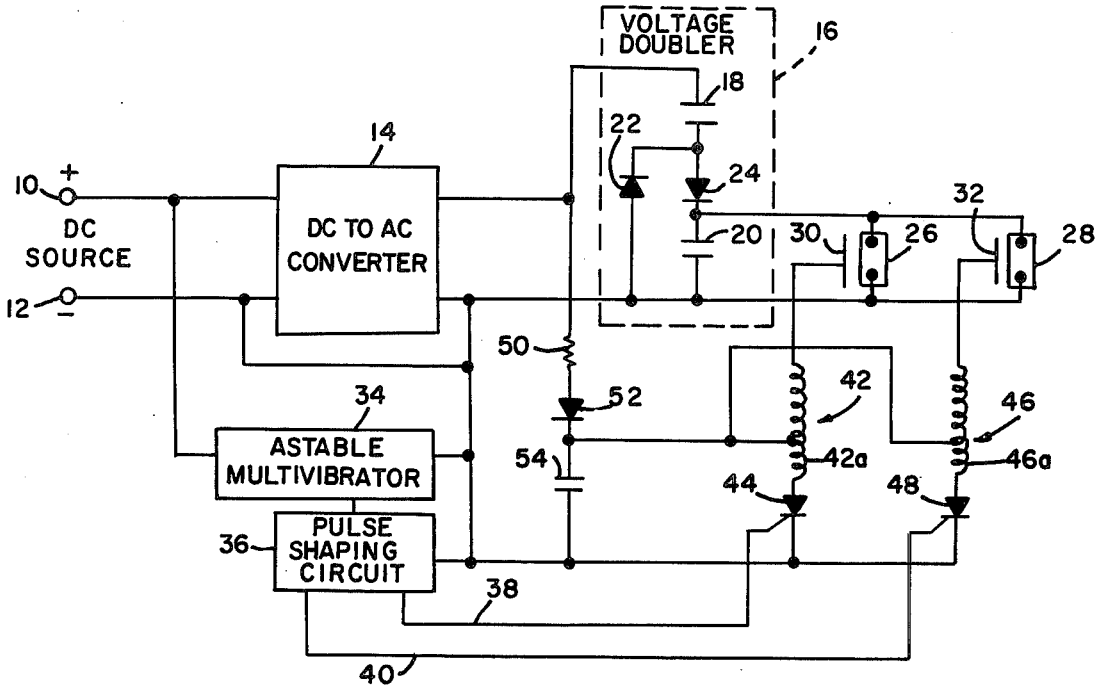
FIG. 1 is a simplified schematic diagram of a multiple flashlamp operating circuit according to the invention in which the lamps are shunt triggered.

Referring to FIG. 1, the operating circuit is powered from a DC voltage source, such as a battery, which is represented by the positive and negative terminals 10 and 12 respectively. A DC to AC converter 14 has a pair of inputs connected to the positive and negative terminals 10 and 12, respectively, and the AC outputs of the converter are illustrated as including a negative reference line output which is connected back to the negative terminal 12. Connected across the AC output of converter 14 is a voltage doubler 16 comprising capacitors 18 and 20 and diodes 22 and 24 connected as illustrated. The output of the voltage doubler 16, which is developed across capacitor 20, is connected in parallel to the supply electrodes of a pair of arc discharge flashlamps 26 and 28. In this manner, in accordance with the invention, a single capacitor 20 functions as the storage discharge device for both of the flashlamps 26 and 28.

The lamps 26 and 28 are illustrated as being shunt triggered via external electrodes 30 and 32 respectively. The trigger pulses for firing the lamps are developed by a circuit comprising an astable multivibrator 34 connected across the DC terminals 10 and 12 and providing an alternating square wave output to a pulse shaping circuit 36. For example, circuit 36 may comprise an active differentiator network for providing sharp, spike-like gating pulses on two separate output lines 38 and 40, each of the two outputs having the same pulse repetition rate but being time interlaced. For example, as illustrated in the timing diagram of FIG. 2, which illustrates a preferred embodiment, each of the output lines 38 and 40 from the pulse-shaping circuit 36 provides a 10-volt, 2-microsecond pulse at 2-second intervals; however, the time phase of one output line is offset by one second with respect to the other output line.

The trigger circuitry further includes an autotransformer 42 and a silicon controlled rectifier (SCR) 44 serially connected in that order between the external electrode 30 (for coupling trigger pulses to lamp 26) and the reference line connected to the negative terminal 12 of the DC source. A second autotransformer 46 and SCR 48 are serially connected in that order between the external electrode 32 of lamp 28 and the reference line connected to the negative terminal 12. Other types of pulse transformers may be substituted for the auotransformers 42 and 46, and other types of gate-controlled switching devices may be employed in lieu of SCR's 44 and 48.

Connected between the positive output terminal of converter 14 and the negative reference line is a charging circuit comprising a charging resistor 50, a diode 52, and a second storage capacitor 54. The junction of diode 52 and capacitor 54 is connected to a tap on both transformers 42 and 46. Hence, in accordance with the invention, the primary winding 42*a* of tranformer 42 and the series-connected SCR 44 are connected in parallel with the primary 46*a* of transformer 46 and its respective series-connected SCR 48 across the storage capacitor 54. The gate electrodes of both SCR 44 and SCR 48 are respectively connected to the two output lines 38 and 40 of the pulse-shaping circuit 36.

Figure 2:
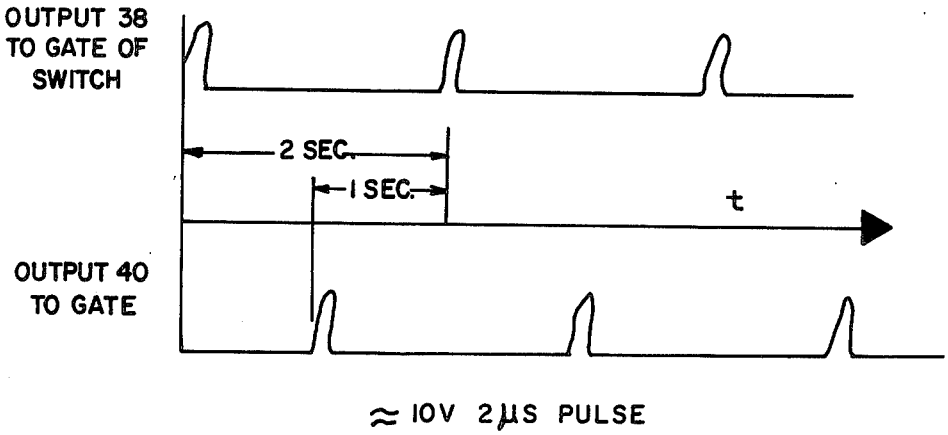
FIG. 2 is a gating pulse diagram related to the circuit of FIG. 1

Referring to FIG. 2, the gating pulses generated on output lines 38 and 40 from the pulse-shaping circuit 36 are alternately applied to the gate electrodes of SCR's 44 and 48 at a fixed time interval; for example, in the specific case illustrated, this fixed time interval is the one second offset between the two pulse trains generated on output lines 38 and 40. As will be described, the gating pulses on outputs 38 and 40 will cause trigger pulses to be alternately applied to flashlamps 26 and 28 at a fixed time interval, this time interval being one second in the specific case illustrated. In view of this time relationship between the alternately applied gating pulses and trigger pulses, the characteristics of converter 14 and the value of capacitor 18 are selected to control the charge rate of capacitor 20 so that, after discharge thereof, the capacitor will become fully charged within the fixed time interval between trigger pulses, e.g., within one second in the preferred embodiment. Of course, it is contemplated that supply circuit arrangements other than voltage doubler 16 may be substituted in this operating circuit, in which case the component values would be selected to similarly control the charge rate of the supply capacitor connected in parallel with the lamps 26 and 28.

In the trigger circuit, resistor 50 and capacitor 54 are selected to provide an RC constant which assures, after having been discharged, capacitor 54 will become fully charged within the fixed time interval between alternating gate pulses, e.g., within one second in the preferred embodiment. Upon energizing the circuit, therefore, the supply circuit capacitor 20 and the trigger circuit capacitor 54 will become fully charged. The generation of the two sets of alternately occuring output pulses on lines 38 and 40 from the pulse-shaping circuit 38 will cause SCR's 44 and 48 to alternately discharge capacitor 54 through the primary windings 42*a* and 46*a*, respectively, of the autotransformers 42 and 46. The resulting high-voltage trigger pulses appearing across the secondaries of transformers 42 and 46 are alternately applied to the external electrodes 30 and 32 to cause alternate triggering of the flashlamps 26 and 28, which are both connected across the storage capacitor 20. Hence, alternate flashing of the lamps 26 and 28 is provided by a DC circuit which includes only one supply storage capacitor 20, which recharges between each lamp flash, and a single trigger capacitor 54, which recharges between each SCR activation by a gating pulse.

Although the described circuit can be made using component values in ranges suitable for each particular application, as is well known in the art, the following table lists component values and types for one specific implementation of a flashlamp operating circuit made in accordance with the present invention:

| | |
|---|---|
| DC source | 9 to 15 volts DC. |
| Converter 14 | 60 watts for converting a 12.6 volt DC input to a 115 volt, 400 Hz. output. |
| Diodes 22, 24, and 52 | 1N4004 |
| Capacitor 18 | 2 microfarads, 400 volts. |
| Capacitor 20 | 300 microfarads, 400 volts. |
| Capacitor 54 | 0.2 microfarad, 250 volts DC. |
| Transformers 42 and 46 | Sylvania A-0425-4E peak voltage 4 KV min. (loaded with 15,000 ohms. with 200 V peak pulse applied). |
| SCR's 44 and 48 | 2N3529 |

The above component values were used in an operating circuit having the specific pulse voltage and timing values illustrated in FIG. 2 for outputs 38 and 40.

Although autotransformers (42 and 46) are described for providing the trigger pulses to the external electrodes 30 and 32, it will be appreciated that other types of pulse transformers may be employed. Further, injection triggering may be employed in lieu of the illustrated shunt triggering arrangement. Hence, although the invention has been described with respect to specific embodiments, it will be appreciated that modifications and changes may be made by those skilled in the art without departing from the true spirit and scope of the invention.

What we claim is:

1. A multiple flashlamp operating circuit comprising, in combination:

a source of DC voltage having positive and negative terminals;

a DC and AC converter having input means connected to the terminals of said DC source and having AC output means;

supply circuit means including a first storage capacitor connected to the AC output of said converter;

first and second arc discharge flashlamps connected in parallel across said first storage capacitor;

respective means for coupling trigger pulses to said first and second lamps; and means connected to and energized by said DC source and the AC output of said converter for generating and alternately applying a succession of high voltage trigger pulses through said respective coupling means to said first and second lamps, whereby said first and second lamps are flashed in alternate sequence, said means for generating and alternately applying trigger pulses comprising: first and second pulse transformers having primary and secondary windings, each of said secondary windings being connected to a respective one of said coupling means; first and second gate-controlled switching devices respectively connected in series with said primary windings; a charging circuit including a second storage capacitor connected to the AC output of said converter, the primary of said first transformer and said series-connected first switching device being connected in parallel with the primary of said second transformer and said series-connected second switching device across said second storage capacitor; and pulse generating means connected to be energized by said DC source and having first and second pulse outputs connected to the control gates of said first and second switching devices respectively.

2. The circuit of claim 1 wherein gating pulses from said pulse generating means are alternately applied to said first and second switching devices at a fixed time interval, and said charging circuit is selected to control the charge rate of said second charging capacitor, after discharge thereof, to provide a full charge thereon within said time interval.

3. The circuit of claim 2 wherein each of said flashlamps has an envelope, and said respective coupling means are shunt triggering means comprising first and second conductive means respectively adjacent to the envelopes of said first and second flashlamps, said first and second transformer secondaries being connected to said first and second conductive means respectively.

4. The circuit of claim 2 wherein said switching devices are controlled rectifiers, and said pulse generating means comprises an astable multivibrator connected to said DC source and an active differentiator pulse shaping circuit connected to the square wave output of said astable, said differentiator circuit providing two output trains of alternately occuring pulses for application to said first and second controlled rectifiers.

5. The circuit of claim 4 wherein the period between pulses in each of said output trains is about two seconds, said fixed time interval is about one second, and the duration of each pulse is in the order of two microseconds.

* * * * *